US007174905B2

(12) United States Patent
Hung

(10) Patent No.: US 7,174,905 B2
(45) Date of Patent: Feb. 13, 2007

(54) SUNSHADE HAVING A TIPPING DEVICE

(76) Inventor: Hsi-Lu Hung, 58, Ma Yuan West St., Taichung (TW)

( * ) Notice: Subject to any disclaimer, the term of this patent is extended or adjusted under 35 U.S.C. 154(b) by 465 days.

(21) Appl. No.: 10/826,937

(22) Filed: Apr. 16, 2004

(65) Prior Publication Data

US 2005/0229958 A1 Oct. 20, 2005

(51) Int. Cl.
*A45B 17/00* (2006.01)

(52) U.S. Cl. ..... 135/20.1; 135/20.3; 135/28

(58) Field of Classification Search ..... 135/20.3, 135/20.1

See application file for complete search history.

(56) References Cited

U.S. PATENT DOCUMENTS 2,721,569 A * 10/1955 Militano ..... 135/20.3
3,129,715 A * 4/1964 Militano et al. ..... 135/20.3
3,150,671 A * 9/1964 Frey ..... 135/20.3
3,489,157 A * 1/1970 Pearlstine ..... 135/20.3
4,582,078 A * 4/1986 Ma ..... 135/20.3
4,878,509 A * 11/1989 Tung ..... 135/20.3
6,446,650 B1 * 9/2002 Ma ..... 135/20.3
6,575,182 B2 * 6/2003 Tung ..... 135/20.1
6,622,741 B2 * 9/2003 Lai ..... 135/20.3
6,810,892 B2 * 11/2004 Lai ..... 135/20.3
6,854,474 B1 * 2/2005 Chen ..... 135/20.3

* cited by examiner

*Primary Examiner*—Tamara L Graysay
*Assistant Examiner*—Danielle Jackson
(74) *Attorney, Agent, or Firm*—Alan D. Kamrath; Nikolai & Mersereau, P.A.

(57) ABSTRACT

A sunshade includes a hollow lower rod, a hollow upper rod located above the lower rod, and a tipping device mounted between the upper rod and the lower rod. The tipping device includes a lower connector, an upper connector, a connecting lever, a drive plate, a tensile spring, and a slide. Thus, the sunshade is disposed between an upright state and an inclined state by controlling the lift cord, so that the tipping device is operated easily and conveniently, thereby facilitating the user operating and tipping the sunshade.

20 Claims, 6 Drawing Sheets

SUNSHADE HAVING A TIPPING DEVICE

BACKGROUND OF THE INVENTION

1. Field of the Invention

The present invention relates to a tipping device for a sunshade, and more particularly to a sunshade having a tipping device that is used to tip the sunshade automatically, thereby facilitating a user operating the sunshade.

2. Description of the Related Art

A conventional sunshade comprises a lower rod, an upper rod located above the lower rod, and a tipping device mounted between the upper rod and the lower rod. Thus, the sunshade is disposed between an upright state and an inclined state by operation of the tipping device. However, the tipping device is not operated easily and conveniently, thereby causing inconvenience to a user when operating and tipping the sunshade.

SUMMARY OF THE INVENTION

The primary objective of the present invention is to provide a sunshade having a tipping device that is used to tip the sunshade automatically, thereby facilitating a user operating the sunshade.

Another objective of the present invention is to provide a sunshade that is disposed between an upright state and an inclined state by controlling the lift cord, so that the tipping device is operated easily and conveniently, thereby facilitating the user operating and tipping the sunshade.

In accordance with the present invention, there is provided a sunshade, comprising a hollow lower rod, a hollow upper rod located above the lower rod, and a tipping device mounted between the upper rod and the lower rod, wherein:

the tipping device includes a lower connector, an upper connector, a connecting lever, a drive plate, a tensile spring, and a slide, wherein:

the lower connector has a lower end secured on an upper end of the lower rod and an upper end having a first side formed with a protruding support block and a second side formed with a receiving recess;

the upper connector has an upper end secured on a lower end of the upper rod and a lower end pivotally mounted on the upper end of the lower connector;

the connecting lever is mounted in the upper rod and the upper connector and has a lower end pivotally mounted on the support block of the lower connector;

the drive plate is pivotal relative to a mediate portion of the upper rod and has a first end pivotally mounted on an upper end of the connecting lever;

the tensile spring is mounted in the upper rod and has a first end secured on the upper end of the connecting lever and a second end secured on an upper end of the upper rod; and the slide is slidably mounted on the upper rod and the lower rod and is movable to press the drive plate so as to move and pivot the drive plate.

Further benefits and advantages of the present invention will become apparent after a careful reading of the detailed description with appropriate reference to the accompanying drawings.

DETAILED DESCRIPTION OF THE INVENTION

Figure 1:
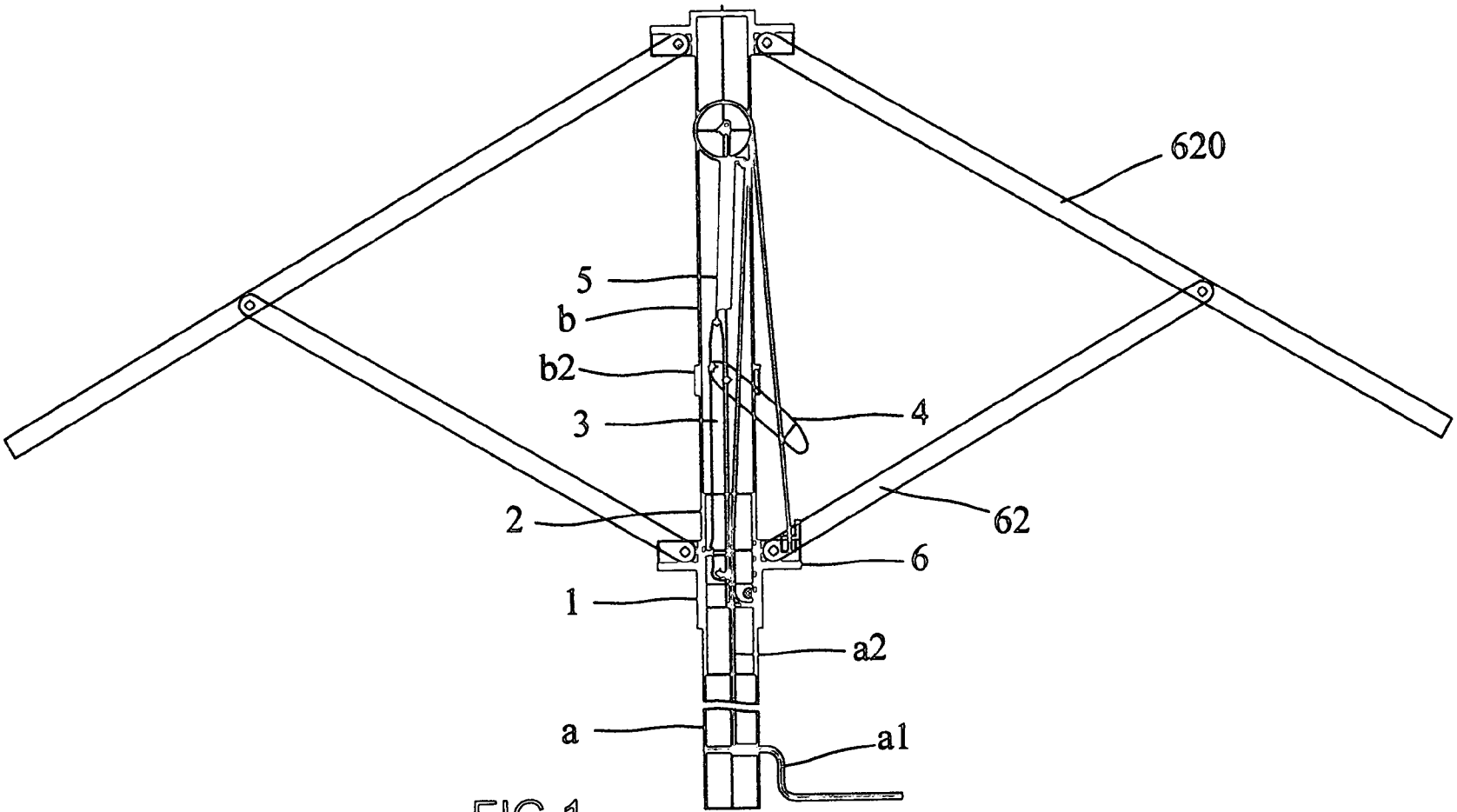
FIG. 1 is a partially cut-away plan view of a sunshade in accordance with the preferred embodiment of the present invention.

Referring to the drawings and initially to FIGS. 1–4, a sunshade in accordance with the preferred embodiment of the present invention comprises a hollow lower rod "a", a hollow upper rod "b" located above the lower rod "a", and a tipping device mounted between the upper rod "b" and the lower rod "a".

The tipping device includes a lower connector 1, an upper connector 2, a connecting lever 3, a drive plate 4, a tensile spring 5, and a slide 6.

The lower connector 1 has a lower end secured on an upper end of the lower rod "a". The lower connector 1 has an upper end having a first side formed with a protruding support block 11 and a second side formed with a receiving recess 12. The support block 11 of the lower connector 1 is substantially U-shaped and has an inside formed with a receiving chamber 112 and two side walls each formed with a pivot hole 111 communicating with the receiving chamber 112. The receiving recess 12 of the lower connector 1 has two sides each formed with a pivot bore 121 communicating with the receiving recess 12.

Figure 3A:
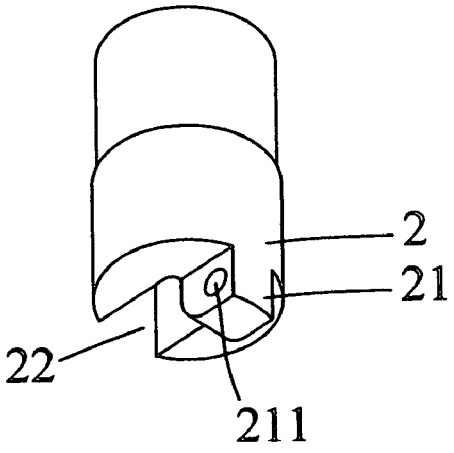
FIG. 3A is a perspective view of an upper connector of the sunshade as shown in FIG. 3.
Figure 3:
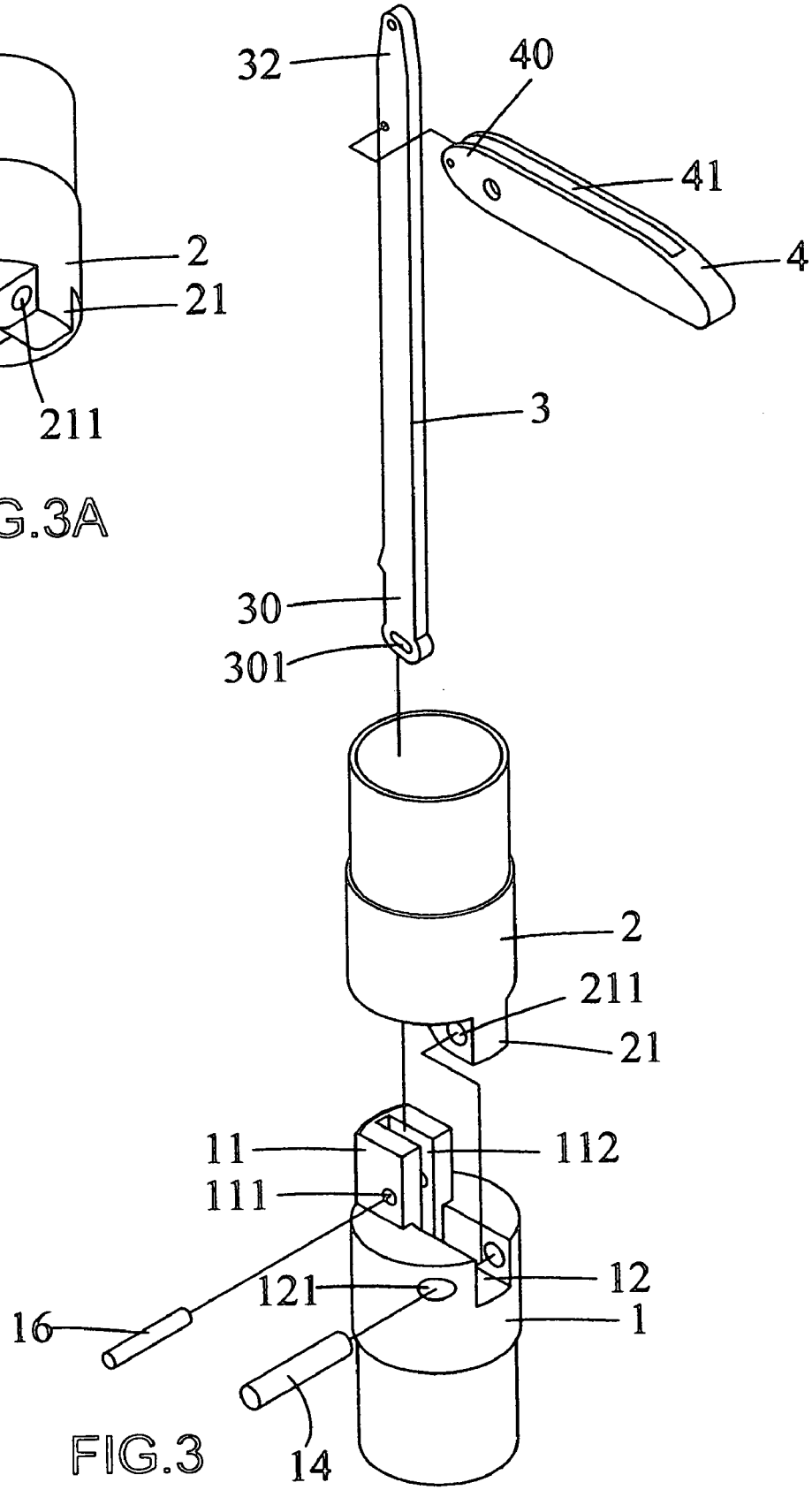
FIG. 3 is a partially exploded perspective view of the sunshade as shown in FIG. 1.
Figure 4:
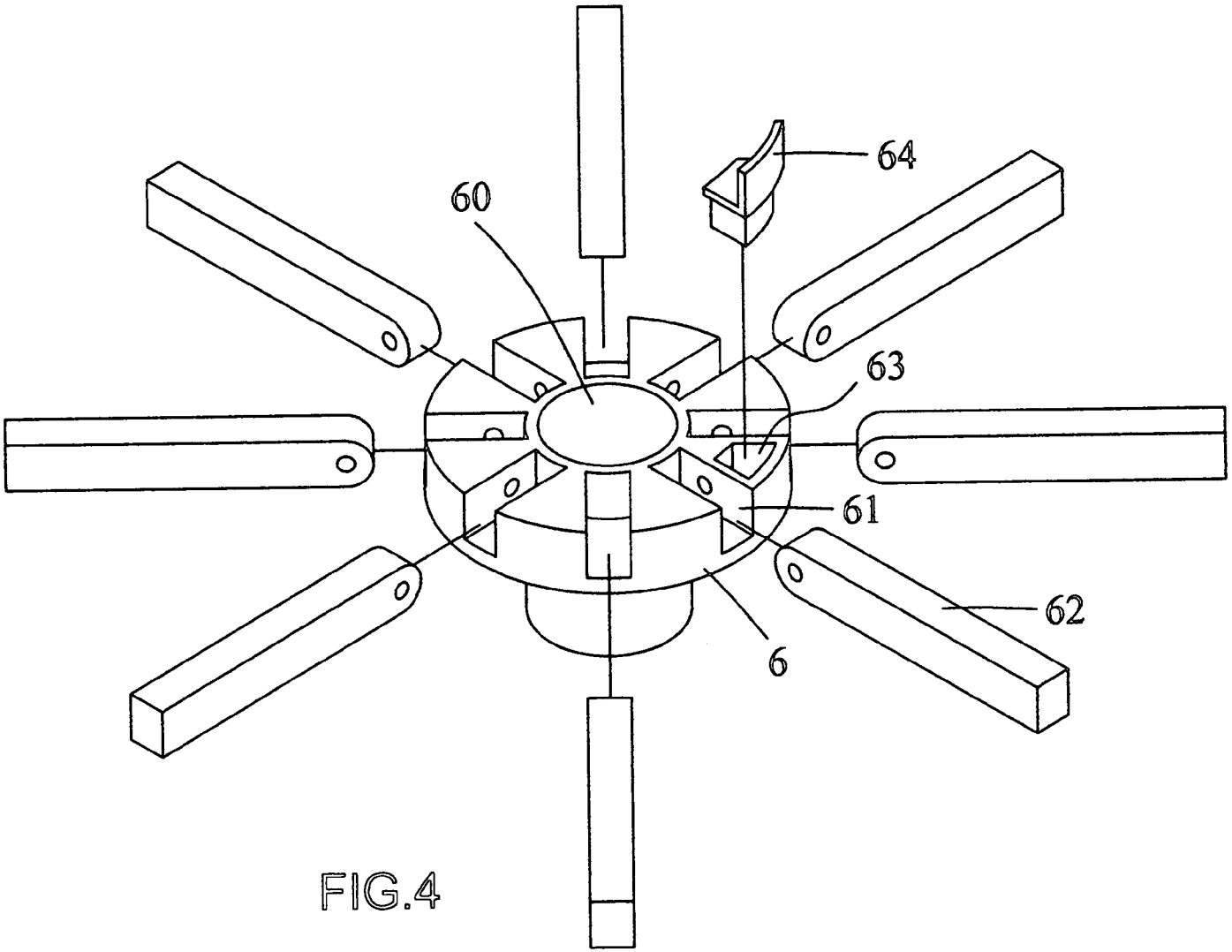
FIG. 4 is a partially exploded perspective view of the sunshade as shown in FIG. 1.

The upper connector 2 is a hollow body and has an upper end secured on a lower end of the upper rod "b" and a lower end pivotally mounted on the upper end of the lower connector 1. The lower end of the upper connector 2 has a first side formed with a protruding pivot seat 21 pivotally mounted in the receiving recess 12 of the lower connector 1. The pivot seat 21 of the upper connector 2 is formed with a pivot hole 211. A pivot shaft 14 is extended through the pivot bore 121 of the receiving recess 12 of the lower connector 1 and the pivot hole 211 of the pivot seat 21 of the upper connector 2, so that the upper connector 2 is pivotally mounted on the lower connector 1. The lower end of the upper connector 2 has a second side formed with an insertion recess 22 (see FIG. 3A), and the support block 11 of the lower connector 1 is mounted in the insertion recess 22 of the upper connector 2.

The connecting lever 3 is mounted in the upper rod "b" and the upper connector 2 and has a lower end 30 pivotally mounted on the support block 11 of the lower connector 1. The lower end 30 of the connecting lever 3 is pivotally mounted in the receiving chamber 112 of the support block 11 of the lower connector 1. The lower end 30 of the connecting lever 3 is formed with an oblong slot 301. A pivot axle 16 is extended through the pivot hole 111 of the support block 11 of the lower connector 1 and the oblong slot 301 of the lower end 30 of the connecting lever 3, so that the lower end 30 of the connecting lever 3 is pivotally mounted on the support block 11 of the lower connector 1.

The drive plate 4 is pivotal relative to a mediate portion of the upper rod "b" and has an end 40 pivotally mounted on an upper end 32 of the connecting lever 3. The drive plate 4 has an inside formed with an elongated slot 41 for mounting the upper end of the connecting lever 3. Preferably, the upper rod "b" has a peripheral wall formed with an opening "b3" (see FIG. 2) for passage of the drive plate 4. A retaining ring "b2" is mounted on the mediate portion of the upper rod "b" and the drive plate 4 is movable to press the retaining ring "b2", so as to limit movement of the drive plate 4 by the retaining ring "b2".

The tensile spring 5 is mounted in the upper rod "b" and has a first end secured on the upper end of the connecting lever 3 and a second end secured on an upper end of the upper rod "b".

Figure 2:
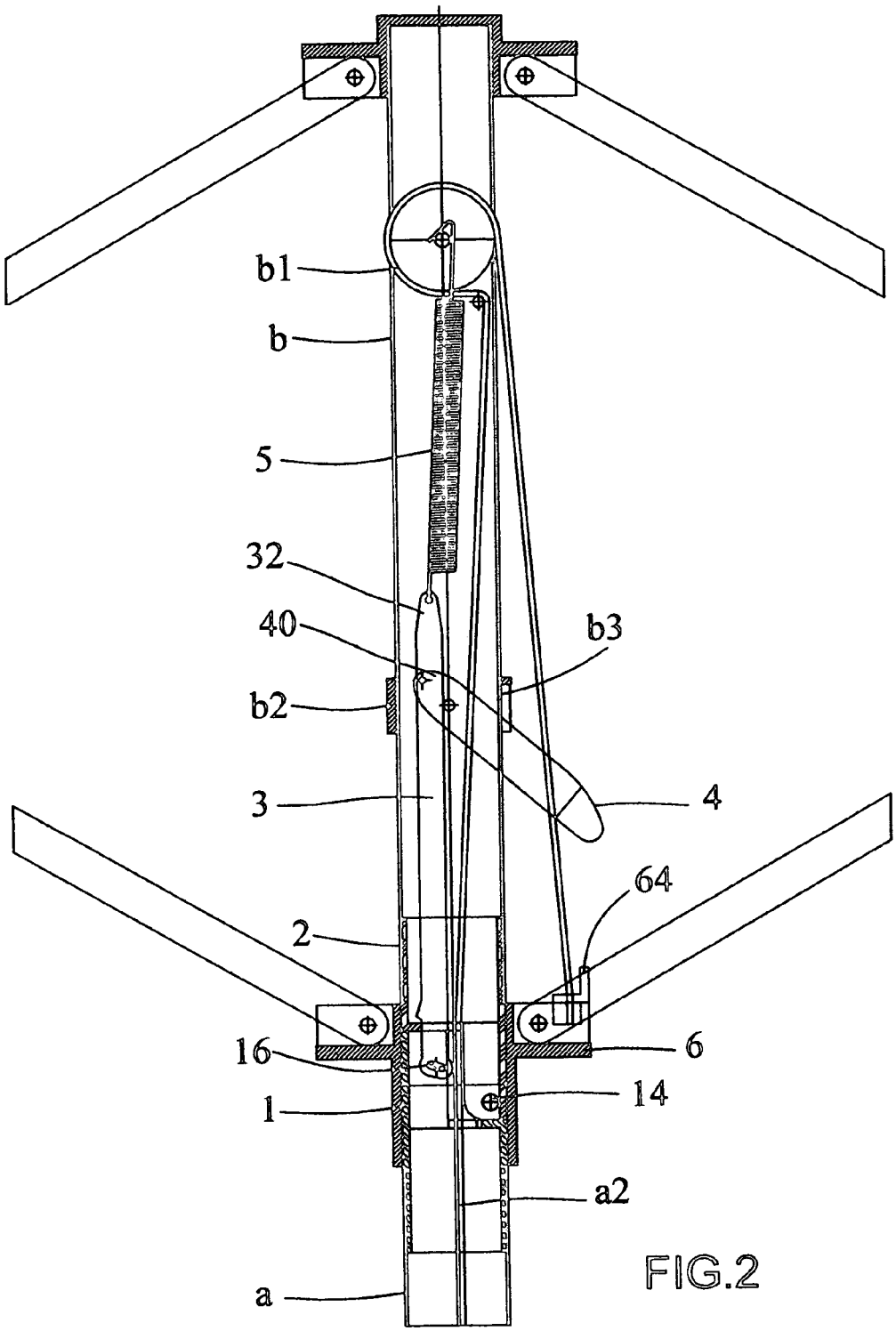
FIG. 2 is a partially enlarged cross-sectional view of the sunshade as shown in FIG. 1.

The slide 6 is slidably mounted on the upper rod "b" and the lower rod "a" and has an inside formed with a mounting hole 60 mounted on the upper rod "b" and the lower rod "a". Preferably, the slide 6 is located on a connection of the upper connector 2 and the lower connector 1 as shown in FIG. 2, so that the upper connector 2 is fixed on the lower connector 1 to form a linear state. The slide 6 is substantially inverted T-shaped and has a top face formed with a locking recess 63. A push block 64 is mounted on the slide 6 to move therewith and is movable to press the drive plate 4 so as to move and pivot the drive plate 4. Preferably, the push block 64 has a lower portion secured in the locking recess 63 of the slide 6.

The sunshade further comprises a plurality of stretchers 62 each having a first end pivotally mounted on the slide 6, a plurality of ribs 620 each having a first end pivotally mounted on a second end of a respective one of the stretchers 62 and a second end pivotally mounted on the upper end of the upper rod "b", a pulley "b1" mounted in the upper end of the upper rod "b", a crank "a1" rotatably mounted on a mediate portion of the lower rod "a", and a lift cord "a2" mounted in the upper rod "b" and the lower rod "a" and having a first end secured on the crank "a1" and a second end reeved through the pulley "b1", extended outward from the upper end of the upper rod "b", extended through the elongated slot 41 of the drive plate 4 and secured on the slide 6 to move the slide 6 upward and downward. Preferably, the slide 6 has a periphery formed with a plurality of pivot channels 61 for mounting the stretchers 62. Preferably, the second end of the tensile spring 5 is secured on the pulley "b1".

In operation, referring to FIGS. 1–6, the slide 6 is located on the connection of the upper connector 2 and the lower connector 1, so that the upper connector 2 is fixed on the lower connector 1 to form a linear state as shown in FIGS. 1 and 2. Thus, the upper rod "b" and the lower rod "a" form a linear state, so that the sunshade is disposed at an upright state as shown in FIG. 1.

Figure 5:
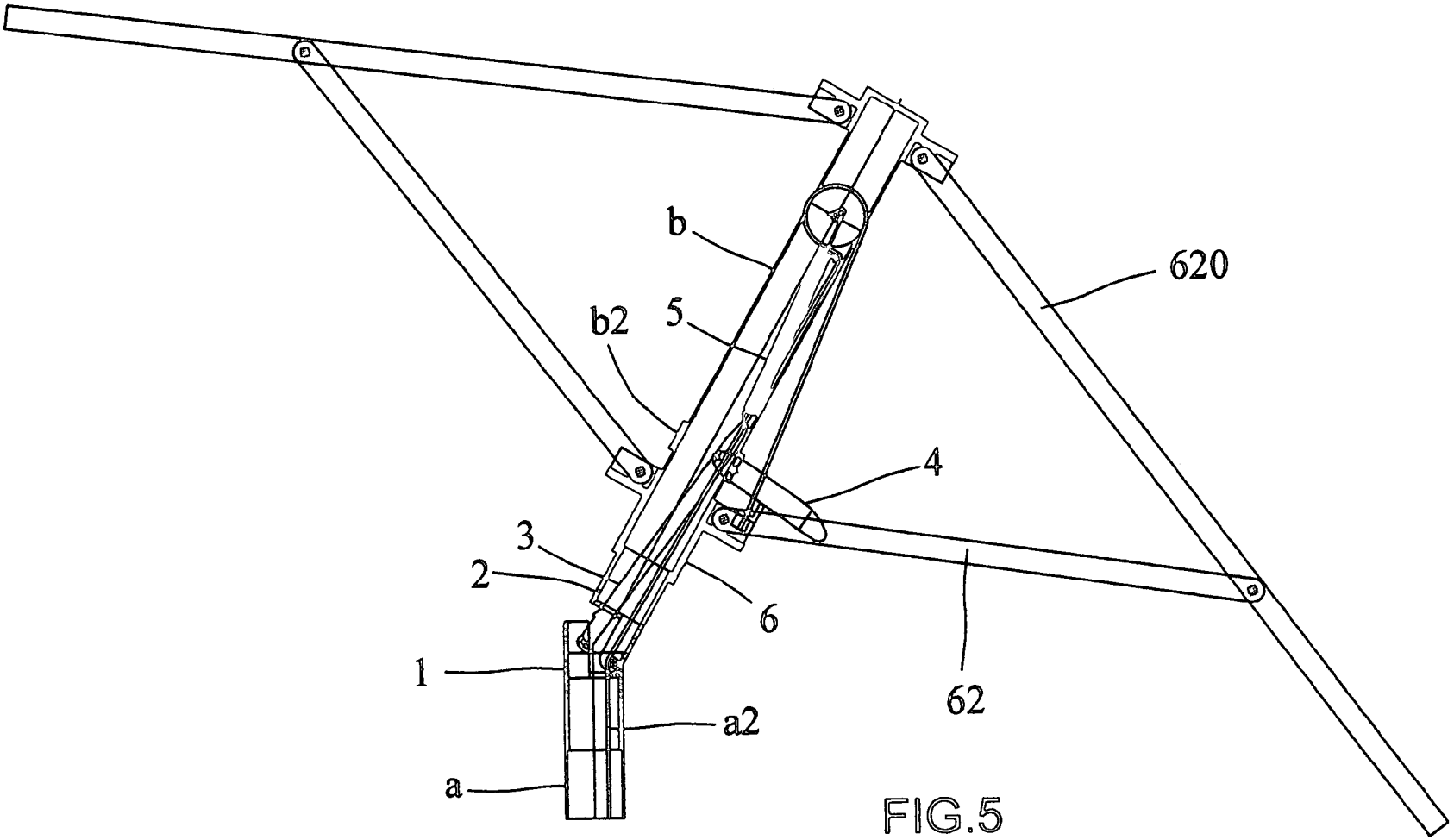
FIG. 5 is a schematic operational view of the sunshade as shown in FIG. 1.
Figure 6:
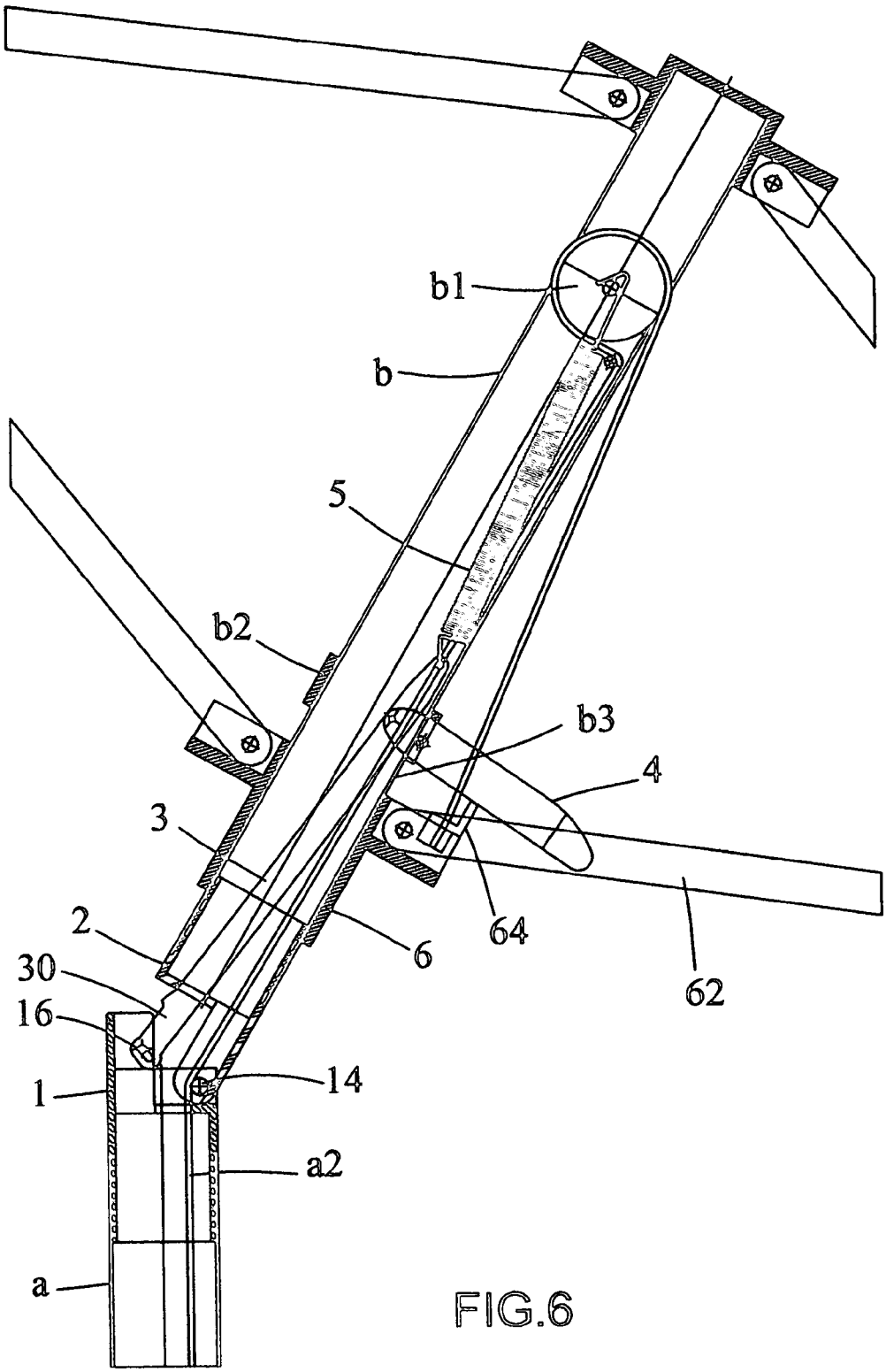
FIG. 6 is a schematic operational view of the sunshade as shown in FIG. 2.

When the crank "a1" is rotated, the lift cord "a2" is wound around the crank "a1" successively to move the slide 6 upward, so that the slide 6 is moved from the position as shown in FIGS. 1 and 2 to the position as shown in FIGS. 5 and 6, thereby releasing the upper connector 2 from the lower connector 1. At this time, the push block 64 is moved with the slide 6 to press the drive plate 4 so as to move and pivot the drive plate 4 upward, thereby indirectly acting on the connecting lever 3 located between the tensile spring 5 and the lower connector 1, so as to move the connecting lever 3, so that the upper connector 2 is detached from and pivoted relative to the lower connector 1 by the gravity of the stretchers 62 and ribs 620, thereby forming an inclined state between the upper connector 2 and the lower connector 1 as shown in FIGS. 5 and 6. Thus, the upper rod "b" is inclined relative to the lower rod "a", so that the sunshade is disposed at an inclined state as shown in FIG. 5. In addition, the retaining ring "b2" mounted on the mediate portion of the upper rod "b" is used to limit excessive movement of the drive plate 4.

When the lift cord "a2" is loosened, the slide 6 is lowered to move the push block 64 downward, thereby detaching the drive plate 4 from the push block 64, so that the connecting lever 3 is loosened. Then, the connecting lever 3 is returned to the original state by the restoring force of the tensile spring 5, so that the upper connector 2 is pivoted toward and rested on the lower connector 1, thereby forming a linear state between the upper connector 2 and the lower connector 1. At this time, the slide 6 is returned to the original position and located on the connection of the upper connector 2 and the lower connector 1, so that the upper connector 2 is fixed on the lower connector 1 to form the original linear state as shown in FIGS. 1 and 2. Thus, the upper rod "b" and the lower rod "a" form the original linear state, so that the sunshade is disposed at an upright state as shown in FIG. 1.

Accordingly, the sunshade is disposed between an upright state and an inclined state by controlling the lift cord "a2", so that the tipping device is operated easily and conveniently, thereby facilitating a user operating and tipping the sunshade.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A sunshade, comprising a hollow lower rod, a hollow upper rod located above the lower rod, and a tipping device mounted between the upper rod and the lower rod, wherein:

the tipping device includes a lower connector, an upper connector, a connecting lever, a drive plate, a tensile spring, and a slide, wherein:

the lower connector has a lower end secured on an upper end of the lower rod and an upper end having a first side formed with a protruding support block and a second side formed with a receiving recess;

the upper connector has an upper end secured on a lower end of the upper rod and a lower end pivotally mounted on the upper end of the lower connector;

the connecting lever is mounted in the upper rod and the upper connector and has a lower end pivotal relative to the support block of the lower connector;

the drive plate is pivotally mounted on a mediate portion of the upper rod and has a first end pivotally mounted on an upper end of the connecting lever;

the tensile spring is mounted in the upper rod and has a first end secured on the upper end of the connecting lever and a second end secured on an upper end of the upper rod; and the slide is slidably mounted on the upper rod and the lower rod and is movable to press the drive plate so as to move and pivot the drive plate.

2. The sunshade in accordance with claim 1, wherein the support block of the lower connector is substantially U-shaped.

3. The sunshade in accordance with claim 1, wherein the support block of the lower connector has an inside formed with a receiving chamber, and the lower end of the connecting lever is pivotally mounted in the receiving chamber of the support block of the lower connector.

4. The sunshade in accordance with claim 3, wherein the support block of the lower connector has two side walls each formed with a pivot hole communicating with the receiving chamber, the lower end of the connecting lever is formed with an oblong slot, and the tipping device further includes a pivot axle extended through the pivot hole of the support block of the lower connector and the oblong slot of the lower end of the connecting lever, so that the lower end of the connecting lever is pivotally mounted on the support block of the lower connector.

5. The sunshade in accordance with claim 1, wherein the lower end of the upper connector has a first side formed with a protruding pivot seat pivotally mounted in the receiving recess of the lower connector.

6. The sunshade in accordance with claim 5, wherein the receiving recess of the lower connector has two sides each formed with a pivot bore communicating with the receiving recess, the pivot seat of the upper connector is formed with a pivot hole, and the tipping device further includes a pivot shaft is extended through the pivot bore of the receiving recess of the lower connector and the pivot hole of the pivot seat of the upper connector, so that the upper connector is pivotally mounted on the lower connector.

7. The sunshade in accordance with claim 5, wherein the lower end of the upper connector has a second side formed with an insertion recess, and the support block of the lower connector is mounted in the insertion recess of the upper connector.

8. The sunshade in accordance with claim 1, wherein the upper connector is a hollow body.

9. The sunshade in accordance with claim 1, wherein the upper rod has a peripheral wall formed with an opening for passage of the drive plate.

10. The sunshade in accordance with claim 1, further comprising a retaining ring mounted on the mediate portion of the upper rod, wherein the drive plate is movable to press the retaining ring so as to limit movement of the drive plate by the retaining ring.

11. The sunshade in accordance with claim 1, wherein the slide has an inside formed with a mounting hole mounted on the upper rod and the lower rod.

12. The sunshade in accordance with claim 1, wherein the slide is located on a connection of the upper connector and the lower connector, so that the upper connector is fixed on the lower connector to form a linear state.

13. The sunshade in accordance with claim 1, wherein the slide is substantially inverted T-shaped.

14. The sunshade in accordance with claim 1, wherein the tipping device further includes a push block mounted on the slide to move therewith and movable to press the drive plate so as to move and pivot the drive plate.

15. The sunshade in accordance with claim 14, wherein the slide has a top face formed with a locking recess, and the push block has a lower portion secured in the locking recess of the slide.

16. The sunshade in accordance with claim 1, wherein the drive plate has an inside formed with an elongated slot for mounting the upper end of the connecting lever.

17. The sunshade in accordance with claim 1, further comprising a plurality of stretchers each having a first end pivotally mounted on the slide, a plurality of ribs each having a first end pivotally mounted on a second end of a respective one of the stretchers and a second end pivotally mounted on the upper end of the upper rod, a pulley mounted in the upper end of the upper rod, a crank rotatably mounted on a mediate portion of the lower rod, and a lift cord mounted in the upper rod and the lower rod and having a first end secured on the crank and a second end reeved through the pulley, extended outward from the upper end of the upper rod, and secured on the slide to move the slide.

18. The sunshade in accordance with claim 17, wherein the drive plate has an inside formed with an elongated slot, and the lift cord is extended through the elongated slot of the drive plate.

19. The sunshade in accordance with claim 17, wherein the slide has a periphery formed with a plurality of pivot channels for mounting the stretchers.

20. The sunshade in accordance with claim 17, wherein the second end of the tensile spring is secured on the pulley.

* * * * *